US010029775B2

(12) United States Patent
Nikmanesh

(10) Patent No.: US 10,029,775 B2
(45) Date of Patent: Jul. 24, 2018

(54) PROPULSION SYSTEM FOR A PERSON OR A WATERCRAFT

(71) Applicant: Houman Nikmanesh, San Diego, CA (US)

(72) Inventor: Houman Nikmanesh, San Diego, CA (US)

( * ) Notice: Subject to any disclaimer, the term of this patent is extended or adjusted under 35 U.S.C. 154(b) by 15 days.

(21) Appl. No.: 15/148,624

(22) Filed: May 6, 2016

(65) Prior Publication Data

US 2016/0325815 A1 Nov. 10, 2016

Related U.S. Application Data

(60) Provisional application No. 62/159,087, filed on May 8, 2015.

(51) Int. Cl.

| | |
|---|---|
| ***B63H 21/17*** | (2006.01) |
| ***A63B 35/00*** | (2006.01) |
| *B63H 20/06* | (2006.01) |
| *B63B 35/71* | (2006.01) |
| *B63B 35/79* | (2006.01) |

(52) U.S. Cl.

CPC ..... *B63H 21/17* (2013.01); *A63B 35/00* (2013.01); *B63B 35/7943* (2013.01); *B63B 2035/715* (2013.01); *B63H 20/06* (2013.01)

(58) Field of Classification Search

CPC ..... B63C 11/46; B63H 20/007; B63H 20/06; B63H 21/17; B63H 23/24; B63B 35/7943

See application file for complete search history.

(56) References Cited

U.S. PATENT DOCUMENTS

| | | | | |
|---|---|---|---|---|
| 5,379,714 A * | 1/1995 | Lewis | B63G 8/08 | 114/315 |
| 2003/0167991 A1* | 9/2003 | Namanny | B63B 35/7926 | 114/55.56 |
| 2012/0309241 A1* | 12/2012 | Yeo | B63C 11/46 | 440/1 |

* cited by examiner

*Primary Examiner* — Andrew Polay

(74) *Attorney, Agent, or Firm* — Perry + Currier Inc.

(57) ABSTRACT

The present disclosure provides that includes a power supply; a propulsion device and an adapter. The propulsion device includes a housing comprising an outer surface, a motor disposed within the housing and coupled to a propeller for generating propulsion forces for propelling the propulsion device; and an electrical connection on the outer surface of the housing and connected to the motor. The adapter comprises an electrical conduit extending between a first end and a second end of the adapter, the first end configured to couple to a support for the power supply and the second end configured to releasably attach to the outer surface of the housing of the propulsion device to form a watertight seal and to electrically connect, via the electrical conduit, the power supply to the electrical connection on the outer surface of the housing to supply power from the power supply to the motor.

19 Claims, 11 Drawing Sheets

PROPULSION SYSTEM FOR A PERSON OR A WATERCRAFT

CROSS-REFERENCE TO RELATED APPLICATIONS

The present disclosure claims priority from U.S. provisional patent application No. 62/159,087 filed May 8, 2015, the contents of which are incorporated herein by reference.

FIELD

The present disclosure relates generally to propulsion systems. More specifically, the present disclosure relates to a propulsion system for use with a watercraft or person for propelling the watercraft or person through a body of water.

BACKGROUND

Various propulsion devices exist that propel people, such as swimmers, snorkelers, scuba divers, and watercrafts, such as surfboards, kayaks, canoes, standup paddle boards and the like, through a body of water. Each of these propulsion devices is designed for a singular purpose of propelling the person or the particular watercraft through a body of water. These various propulsion devices are not interchangeable and hence cannot be used for multiple purposes of propelling a person and various different types of watercraft.

SUMMARY

According to one aspect of an embodiment, a propulsion system includes a power supply, a propulsion device comprising: a housing comprising an outer surface; a motor disposed within the housing and coupled to a propeller for generating propulsion forces for propelling the propulsion device; and an electrical connection on the outer surface of the housing, the electrical connection being connected to the motor. The propulsion device also includes an adapter comprising a first end, a second end, and an electrical conduit extending between the first end and the second end, the first end configured to couple to a support for the power supply and the second end configured to releasably attach to the outer surface of the housing of the propulsion device to form a watertight seal and to electrically connect, via the electrical conduit, the power supply to the electrical connection on the outer surface of the housing to supply power from the power supply to the motor.

The support may be a power supply unit and the power supply may be encased within the power supply unit.

The power supply unit may also include an electrical contact connected to the power supply, and the first end of the adapter may be configured to attach to the power supply unit to electrically connect the electrical conduit to the electrical contact of the power supply unit.

The adapter may also include a trigger mechanism electrically connected to the motor via the electrical conduit and may be configured to control operation of the motor.

The propulsion device may also include a processor configured to throttle the motor when depression of the trigger mechanism is detected and to turn off the motor when release of the trigger mechanism is detected.

The adapter may be shaped to be grasped by a hand of a person for propelling the person.

The propulsion system may also include a power supply pack disposed on the support. The power supply may be encased within the power supply pack.

The electrical conduit may be an electrical cable coupled to power supply for electrically connecting the power supply to the motor.

The propulsion device may also include a processor for controlling the motor.

The propulsion system may also include a controller configured to communicate with the processor of the propulsion device for controlling the propulsion device and for receiving information related to the operation of the propulsion device.

The power supply unit may also include a processor and the processor of the power supply unit may communicate with the processor of the propulsion device.

The controller may communicate wirelessly with the processor of the power supply unit.

The propulsion system may also include an attachment adapter comprising a first attachment end configured to mount to the support and a second attachment end configured to attach to the first end of the adapter.

The support may be a watercraft comprising a fin box and the first attachment end may mount to the fin box of the watercraft.

The support may be a kayak and the first attachment end may be mounted to a surface of the kayak.

The support may be a watercraft comprising a belly and the first attachment end may mount within the belly of the watercraft.

The propulsion system may also include a hose configured for attachment to the propulsion device to pump water ejected by the propeller through the hose.

The propulsion device may also include a coupling mechanism disposed on the outer surface of the housing, the coupling mechanism configured to releasably attach to a complementary coupling mechanism at the second end of the adapter to form a watertight seal between the second end of the adapter and the outer surface of the housing.

The electrical connection of the propulsion device may be disposed within the coupling mechanism on the outer surface of the housing.

BRIEF DESCRIPTION OF THE DRAWINGS

Embodiments of the present invention will be described, by way of example, with reference to the drawings and to the following description, in which.

DETAILED DESCRIPTION

Figure 1:
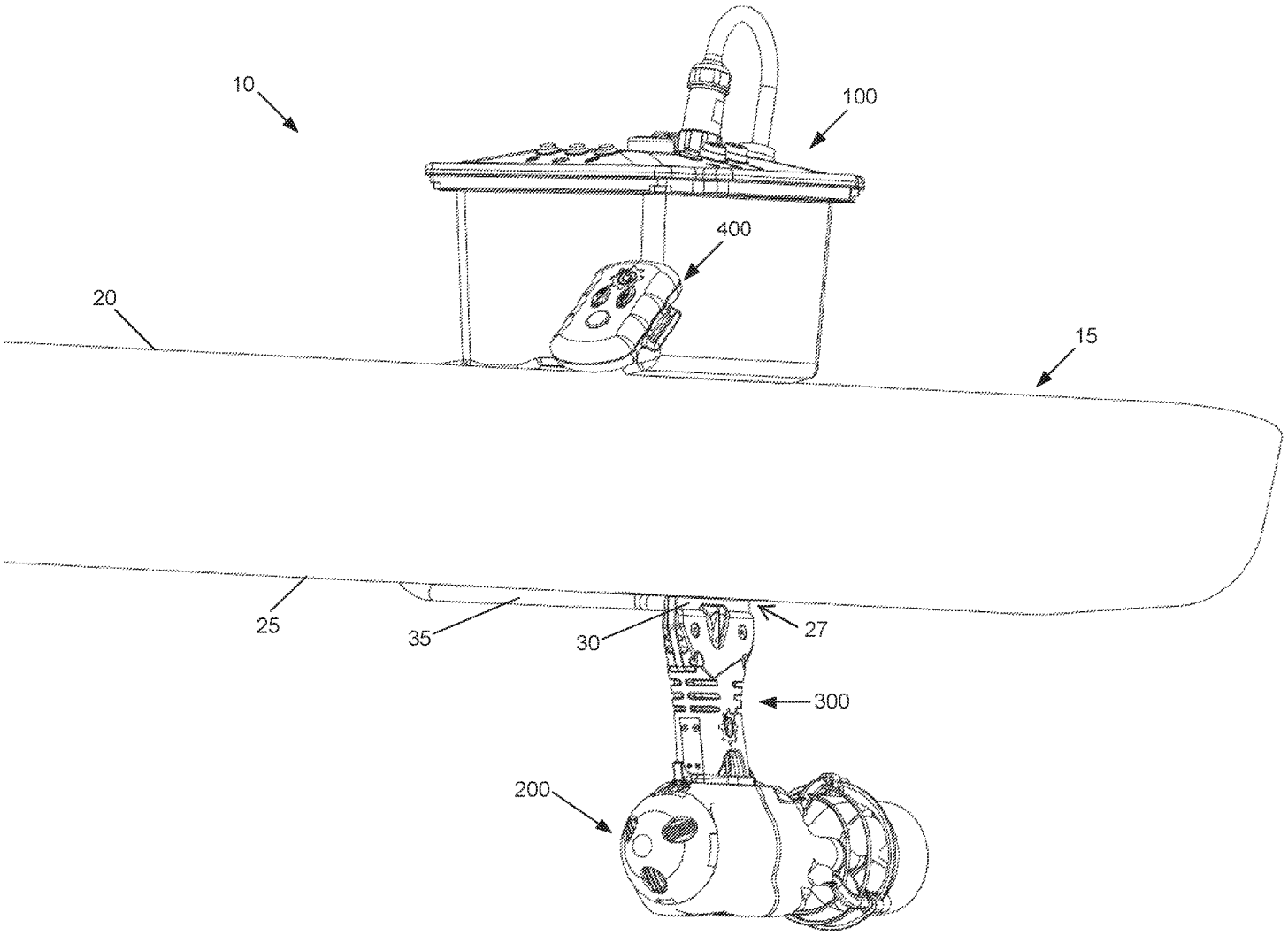
FIG. 1 is a perspective of a propulsion system mounted to a fin box of a stand-up paddle board in accordance with an embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The present disclosure generally relates to a propulsion system for propelling either a person, such as a diver, swimmer, or snorkeler, or a watercraft such as for example, a kayak, a canoe, a surfboard, or a standup paddleboard, through a body of water.

FIG. 1 to FIG. 8 illustrate an embodiment of a propulsion system 10 in which the propulsion system 10 is used with a stand-up paddle board (SUP) 15 to propel the SUP 15 through a body of water. The SUP 15 has a top surface 20 and an opposing bottom surface 25 for placement on a body of water. The propulsion system 10 is mounted to a fin box 27 formed in the bottom surface 25 of the SUP 15 using an attachment adapter 30, as described in further detail below. The propulsion system 10 includes a power supply pack 100 that houses a power supply, a propulsion device 200, and an adapter 300. The power supply pack 100 is disposed on the top surface 20 of the SUP 15 such that the SUP 15 supports the power supply inside the power supply pack 100.

The propulsion device 200 includes a housing 202 and a motor 204 (FIG. 2) disposed within the housing 202. The motor 204 is coupled to a propeller 206 and is configured to generate propulsion forces for propelling the propulsion system 10 through a body of water. The propulsion device 200 also includes an electrical connection 208 (FIG. 2) on an outer surface 210 of the housing 202. The electrical connection 208 is connected to the motor 204, as described in further detail below.

The adapter 300 (see FIG. 4) includes a first end 302, a second end 304, an electrical conduit 306 extending between the first end 302 and the second end 304. The first end 302 of the adapter 300 is configured to couple to the attachment adapter 30 which, in the illustrated embodiment, is mounted to the fin box (not shown) formed in the bottom surface 25 of SUP 15 that supports the power supply within the power supply pack 100. The second end 304 of the adapter 300 is configured to releasably attach to the outer surface 210 of the housing 202 of the propulsion device 200 to form a watertight seal and to electrically connect, via the electrical conduit 306 of the adapter 300, the power supply pack 100 to the electrical connection 208 on the outer surface 210 of the housing 202 to supply power from the power supply pack 100 to the motor 204 as described in further detail below.

Figure 2:
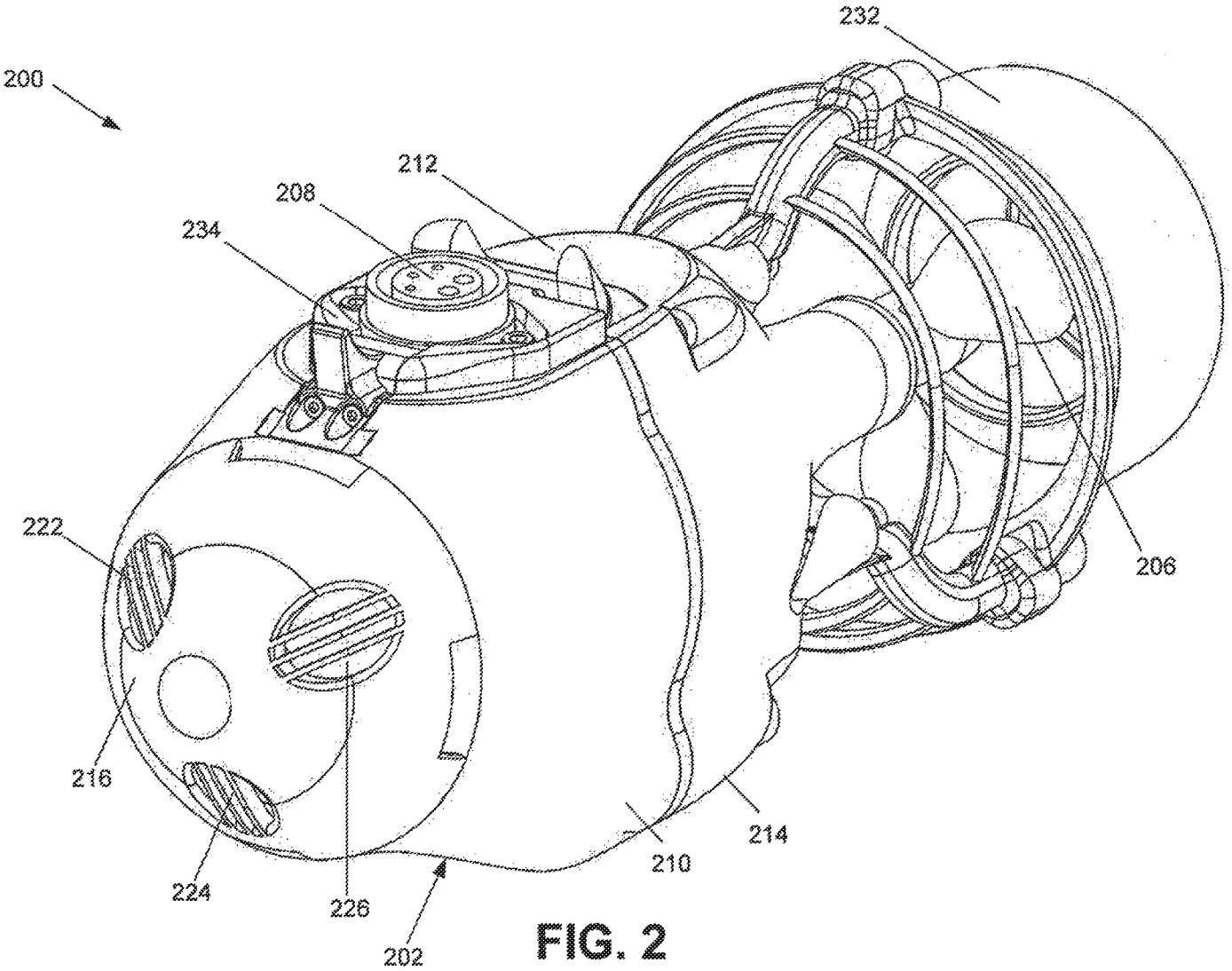
FIG. 2 is a perspective view of the propulsion device of FIG. 1.
Figure 3:
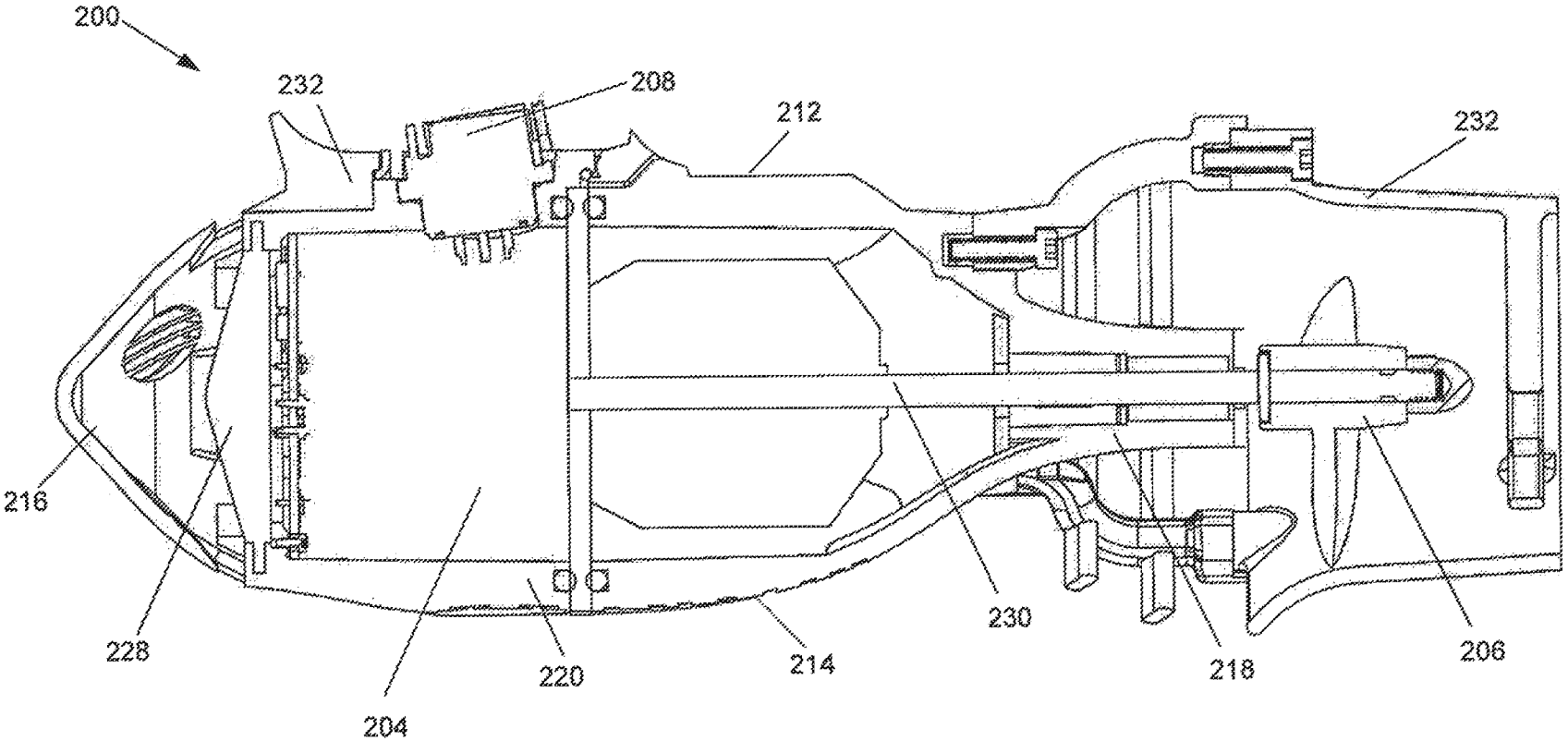
FIG. 3 is a cutaway side view of a propulsion device of FIG. 1.

FIG. 2 and FIG. 3 show a perspective view and a cutaway side view of the propulsion device 200 of FIG. 1. The housing 202 of the propulsion device 200 has a top 212, a bottom 214, a front 216, a back 218, and middle 220 between the front 216 and the back 218. The front 216 of the housing 202 includes three water inlets 222, 224, 226 (FIG. 1). A heat sink 228 is disposed within the housing 202 proximate the front 216 of the housing 202. The motor 204 is disposed within the middle 220 of the housing 202 behind the heat sink 228. The motor 204 may be any suitable motor such as, for example, en electric motor, a hybrid electric motor, and the like. Each water inlet 222, 224, 226 is configured to direct water into the heat sink 228 when the propulsion device 200 is placed into a body of water and propelled through the body of water to cool the motor 204. Although the propulsion device 200 shown in FIG. 1 to FIG. 3 includes three water inlets 222, 224, 226, the front 216 of the housing 202 may it include other suitable numbers of water inlets.

Referring to FIG. 3, the motor 204 is coupled to the propeller 206 via a shaft 230 that is disposed within the housing 202 and extends from the motor 204 to the back 218 of the housing 202 and out the back 218 of the housing 202. The propeller 206 is affixed to the shaft 230 that extends out the back 218 of the housing 202. A propeller guard 232 is attached to the outer surface 210 of the housing 202 at the back 218 of the housing 202. The propeller guard 232 surrounds the propeller 206 to protect the propeller 206 from debris in the body of water and protect user and other objects from harm due to contact with the propeller 206. The propulsion device 200 includes a processor (not shown) that is configured to control a direction of rotation of the shaft 230 so that the shaft 230 rotates clockwise or counterclockwise to generate thrust for propelling the propulsion system 10 in a forward or reverse direction through a body of water. The processor (not shown) may also be configured to control a rate of rotation of the shaft 230 to control the thrust generated by the propulsion device 200. The processor (not shown) may be any suitable microprocessor, field programmable gate array (FPGA), electronic circuit and the like that is programmable to control the operation of the motor 204.

Although the propulsion device 200 shown in FIG. 2 includes a propeller guard 232, in alternative embodiments, the propulsion device 200 may not include the propeller guard 232.

Referring again to FIG. 2, a coupling mechanism 234 is disposed on the outer surface 210 of the housing 202 at the top 212 of the housing 202. The coupling mechanism 234 is releasably attachable to and detachable from a complementary coupling mechanism 308 (FIG. 6) at the second end 304 of the adapter 300. The coupling mechanism 234 may be any suitable mechanism that mechanically attaches to the complementary coupling mechanism 308 at the second end 304 of the adapter 300 to form a watertight seal between the second end of the adapter 300 and the outer surface 218 of the propulsion device and detaches from the complementary coupling mechanism 308 at the second end 304 of the adapter 300. In the embodiment illustrated in FIG. 1 to FIG. 7, the coupling mechanism 234 of the propulsion device 200 comprises a base and the coupling mechanism 308 of the adapter 300 comprises protrusions that cooperate with the base to form a watertight seal between the second end 304 of the adapter 300 and the outer surface 210 of the housing 202 of the propulsion device 200. The coupling mechanism 234 also includes a lock that cooperates with a protrusion at the second end 304 of the adapter 300 to lock the adapter 300 to the outer surface 210 of the housing 202.

It will be appreciated that the complementary coupling mechanisms 234, 308 shown in embodiment of FIG. 1 to FIG. 7 are to be taken as examples only. The propulsion device 200 and the adapter 300 may include any suitable complementary coupling mechanisms 234, 308 for mechanically attaching the second end 304 of the adapter 308 to the outer surface 210 of the housing 202 of the propulsion device to form a watertight seal therebetween. Examples of other suitable complementary coupling mechanisms include, but are not limited to, complementary mechanisms that provide an interference fit, fasteners and apertures shaped and dimensioned to receive the fasteners to secure the propulsion device 200 to the adapter 300, metal inserts with apertures for receiving screws to secure the propulsion device 200 to the adapter 300, and complementary magnetic couplers.

Referring again to FIG. 3, the propulsion device 200 also includes the electrical connection 208 on an outer surface 210 of the housing 202. The electrical connection 208 may be any suitable connection that electrically connects the electrical conduit 306 to the motor 204 for supplying power to the motor 204, such as, for example a socket or an electrical contact. In the embodiment illustrated in FIG. 2 and FIG. 3, the electrical connection 208 is positioned within the coupling mechanism 234. The electrical connection 208 comprises a socket that includes electrical contacts that electrically connect to the motor 204 to supply power from the power supply pack 100, the electrical conduit 306 and the electrical connection 208 to the motor 204.

Although the electrical connection 208 is shown in FIG. 2 and FIG. 3 disposed within the coupling mechanism 234, in an alternative embodiment, the electrical connection 208 may be disposed anywhere on the outer surface 210 of the housing 202. In this alternative embodiment, a cable (not shown) may connect the electrical conduit 306 to the electrical connection 208.

Figure 4:
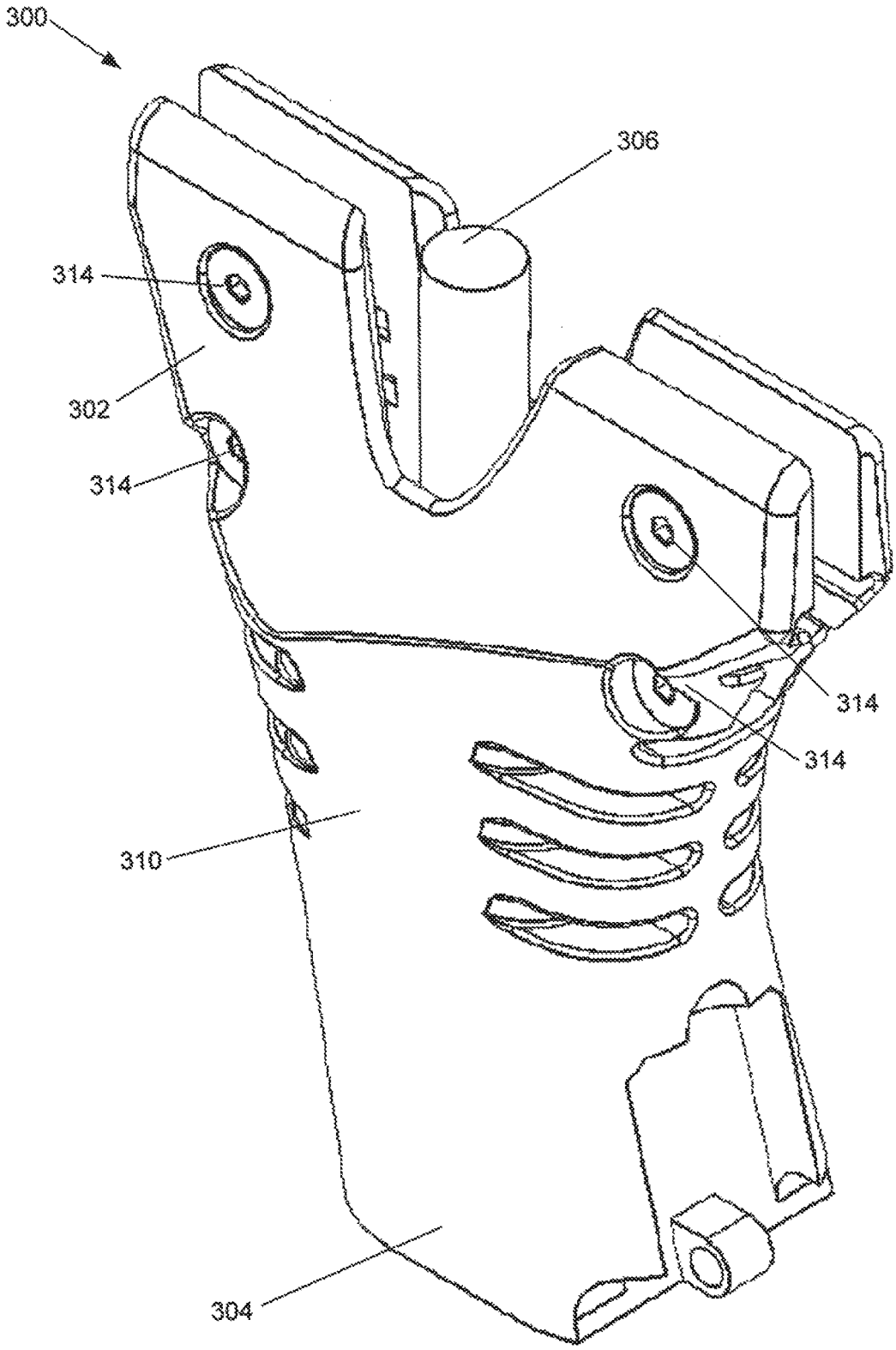
FIG. 4 is a perspective view of the adapter of FIG. 1.
Figure 5:
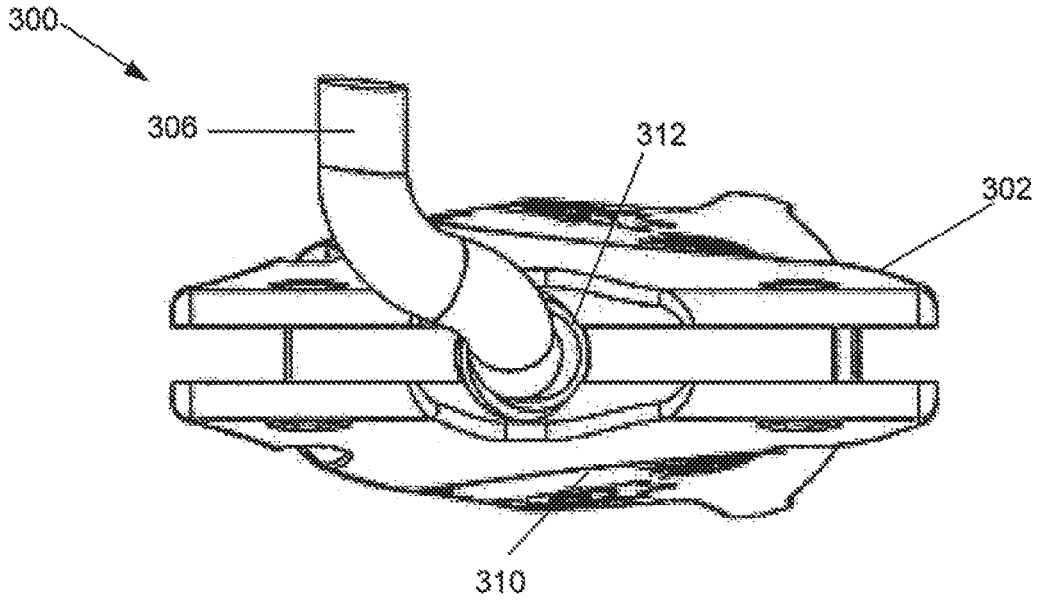
FIG. 5 is a top view of the adapter of the propulsion system of FIG. 1.
Figure 6:
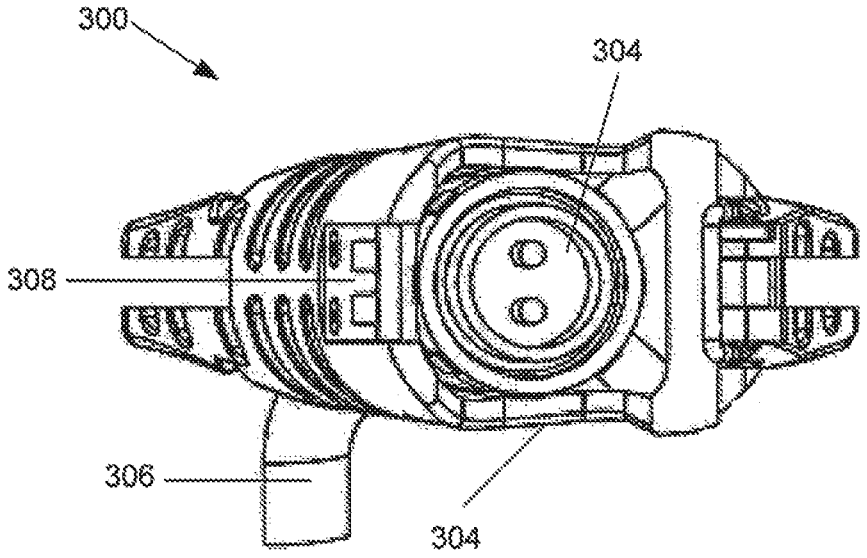
FIG. 6 is bottom view of the adapter of the propulsion system of FIG. 1.

Referring to FIG. 4, FIG. 5, and FIG. 6, a cutaway side view, a top view and a bottom view of the adapter 300 are shown. The adapter 300 includes a body 310 that extends from the first end 302 to the second end 304. The body 310 includes a passageway 312 (FIG. 5) that extends through the body 310 from the first end 302 to the second end 304. In the embodiment illustrated in FIG. 4, FIG. 5, and FIG. 6, the electrical conduit 306 is disposed within the passageway 312 and extends from the first end 302 to the second end 304 of the adapter 300. The electrical conduit 306 includes a plug that has electrical contacts that are configured for insertion into apertures of the electrical connection 208. The electrical contacts of the plug include a power contact and leads for controlling and adjusting the operation of the propulsion device 200 and the processor of the propulsion device 200

Although the electrical conduit 306 is shown disposed within the passageway 312 of the body 310 of the adapter 300 in the embodiment shown in FIG. 4, FIG. 5, and FIG. 6, in an alternative embodiment, the electrical conduit 306 may be disposed outside the body 310 of the adapter 300 and extend from the first end 302 of the adapter 300 to the electrical connection 208 located on the outer surface 210 of the housing 202 of the propulsion device 200. In this alternative embodiment, the electrical conduit 306 encased within a cable.

Referring to FIG. 4, the first end 302 of the adapter 300 is open to receive a portion of the attachment adapter 30 (see FIG. 7) therein. The body 310 includes apertures 314 each sized to receive a fastener 320 (FIG. 7) for securely retaining a portion of the attachment adapter 30 within the first end 302 of the adapter 300. Fastener 320 may be any suitable fastener, such as for example, a screw, a bolt, and the like. It will be appreciated that in alternative embodiments, any suitable securing element may be utilized to secure a portion of the attachment adapter 30 within the first end 302 of the adapter 300 or any other adapter such as 1300 [FIG. 11]

Figure 7:
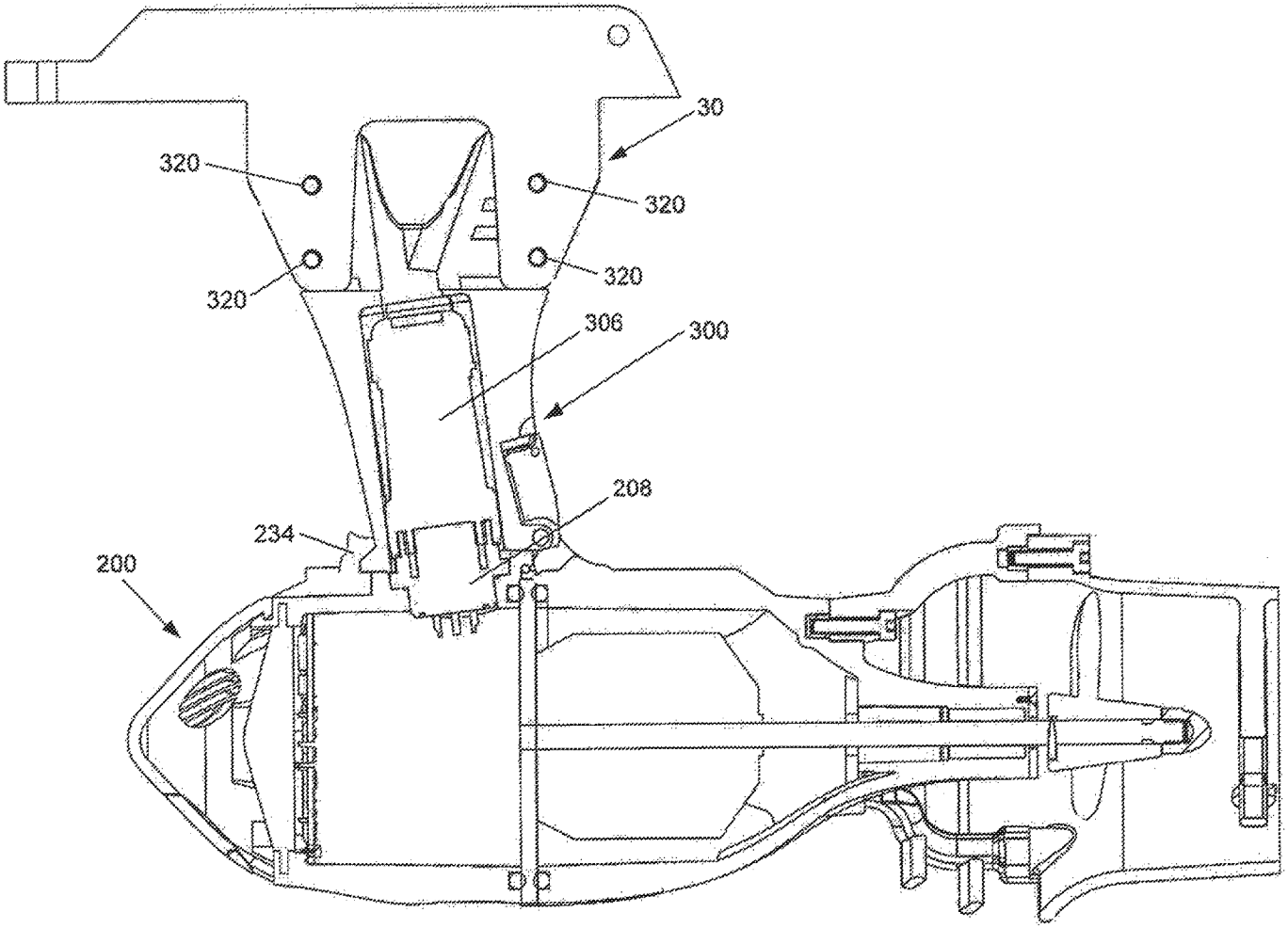
FIG. 7 is a cutaway side view of the propulsion device, the adapter, and the attachment adapter of FIG. 1.

Referring to FIG. 7, a cutaway vie of the propulsion device 200, the adapter 300 and the attachment adapter 30 is shown in which the adapter 300 is coupled to both the propulsion device 200 and the attachment adapter 30. As illustrated in FIG. 7, the attachment adapter 30 is received within the first end 302 of the adapter 300 and is securely attached thereto using fasteners 320. The coupling mechanism 308 of the adapter 300 is attached to the coupling mechanism 234 on the top 212 of the housing 202 such that the plug is inserted into the socket to electrically connect the electrical conduit 306 to the electrical connection 208.

Figure 8:
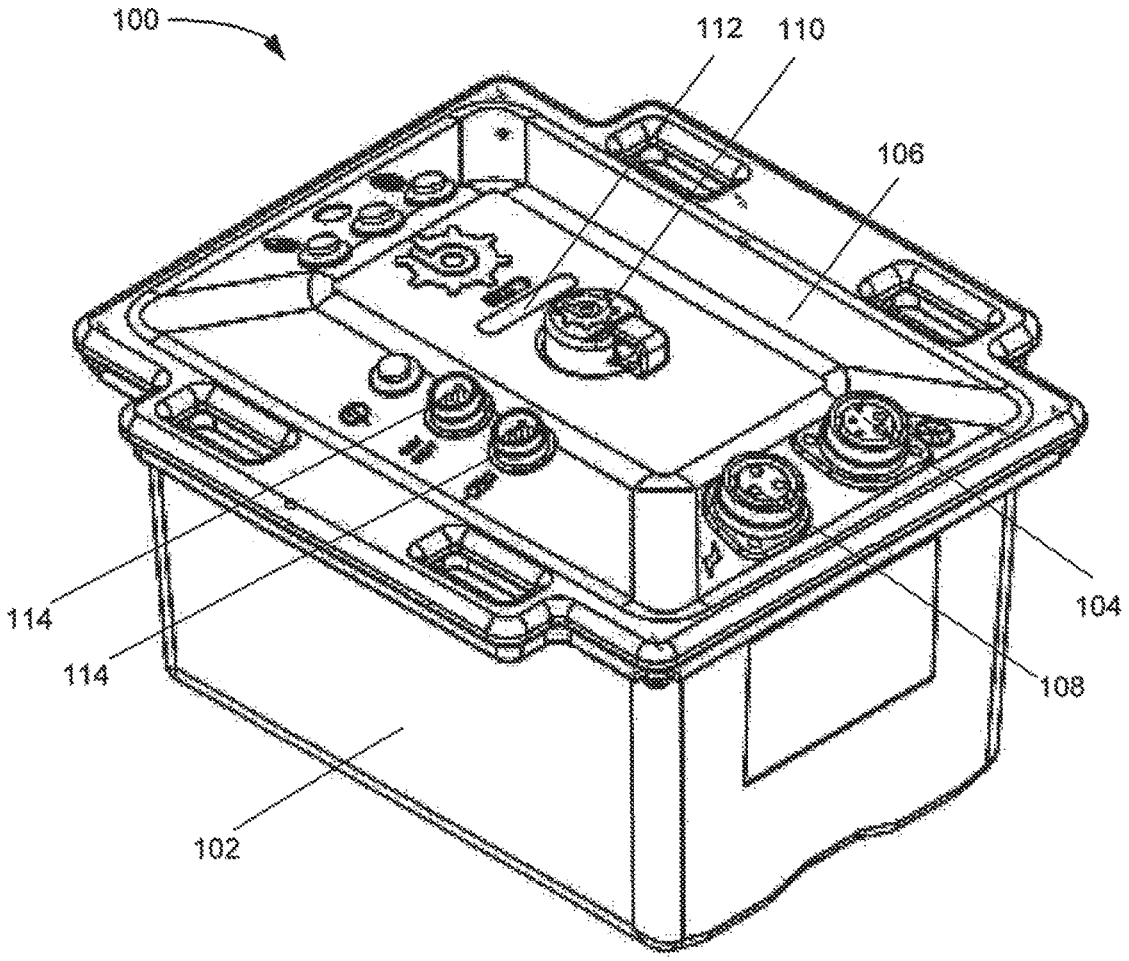
FIG. 8 is a perspective view of the power supply of FIG. 1.

Referring now to FIG. 8, a perspective view of an example embodiment of the power supply pack 100 of the propulsion system 10 is shown. The power supply pack 100 includes a watertight casing 102 (hereinafter casing 102) that houses the power supply (not shown). The power supply pack 100 includes an electrical contact 104 disposed on a top surface 106 of the casing 102 that is electrically connected to power supply (not shown) housed within the power supply pack 100. The power supply (not shown) may be any suitable power supply that supplies electrical power to the propulsion device 200 as described above, such as, for example a battery or a bank of batteries. It will be appreciated that the electrical contact 104 may be disposed at any suitable location on the casing 102. The power supply pack 100 also includes a processor (not shown) configured to communicate with the processor (not shown) of the propulsion device 200 to control operation of the propulsion device 200, as described in further detail below. Optionally, the casing 102 may include one or more of a charge port 108 electrically connected to the power supply for charging the power supply when connected to a charger; a "kill" switch 110 for disconnecting the power supply from the electrical contact 104; an indicator 112 for indicating a status of the power supply; and auxiliary power connections 114 for supplying power to the power supply (not shown).

Referring again to FIG. 1, the propulsion system 10 may include a cable 35 for attaching the electrical conduit 306 of the adapter 300 to the electrical contact 104 on the power supply pack 100. When the cable 35 is attached to the electrical contact 104 and the electrical conduit 306, the power supply (not shown) housed in the power supply pack 100 supplies power to the propulsion device 200 via the cable 35, the electrical conduit 306, and the electrical connection 208. The processor (not shown) of the power supply pack 100 also communicates with the processor (not shown) of the propulsion device via the cable 35, via the cable 35, the electrical conduit 306, and the electrical connection 208. Optionally, the propulsion system 10 may also include a controller 400 configured to wirelessly communicate with the processor (not shown) of the power supply pack 100, which in turn, communicates with the processor (not shown) of the propulsion device 200 to control the operation of the propulsion system 10, as described in further detail below.

Figure 9:
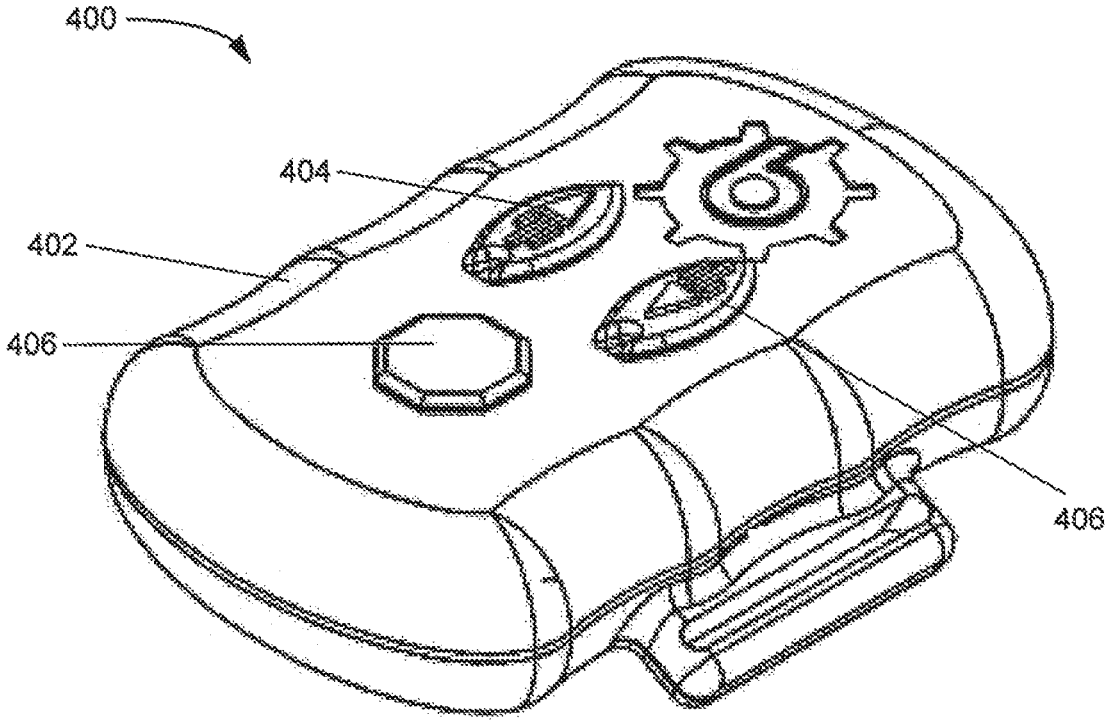
FIG. 9 is a perspective view of a controller for use with the propulsion system of FIG. 1 in accordance with an embodiment.

Referring to FIG. 9, an example embodiment of the controller 400 is shown. The controller 400 includes a processor (not shown) and input devices 402,404, 406 for controlling operation of the propulsion device 200. When an input device 402, 404, 406 is actuated, the processor (not shown) detects the actuation of the input device 402, 404, 406 and communicates wirelessly with the processor (not shown) of the power supply pack 100, using any suitable wireless protocol, such as, for example Wi-Fi, Bluetooth, and the like, to control the operation of the propulsion device 200. The processor (not shown) of the power supply pack 100 relays signals received from the processor (not shown) of the controller 400 to the processor (not shown) of the propulsion device 200 via the cable 35, the electrical conduit 306, and the electrical connection 208. Using the controller 400, a user of the propulsion system 10 can control a speed and a direction of propulsion of the propulsion device 200 using input devices 402, 404, 406. Optionally, a user of the propulsion system 10 can also, using the controller 400, shut down the propulsion device 200, or obtain, from the power supply pack 100, information related to the operation of the power supply pack 100 or obtain, from the propulsion device 200 via the power supply pack 100, information related to the operation of the propulsion device 200.

Figure 10:
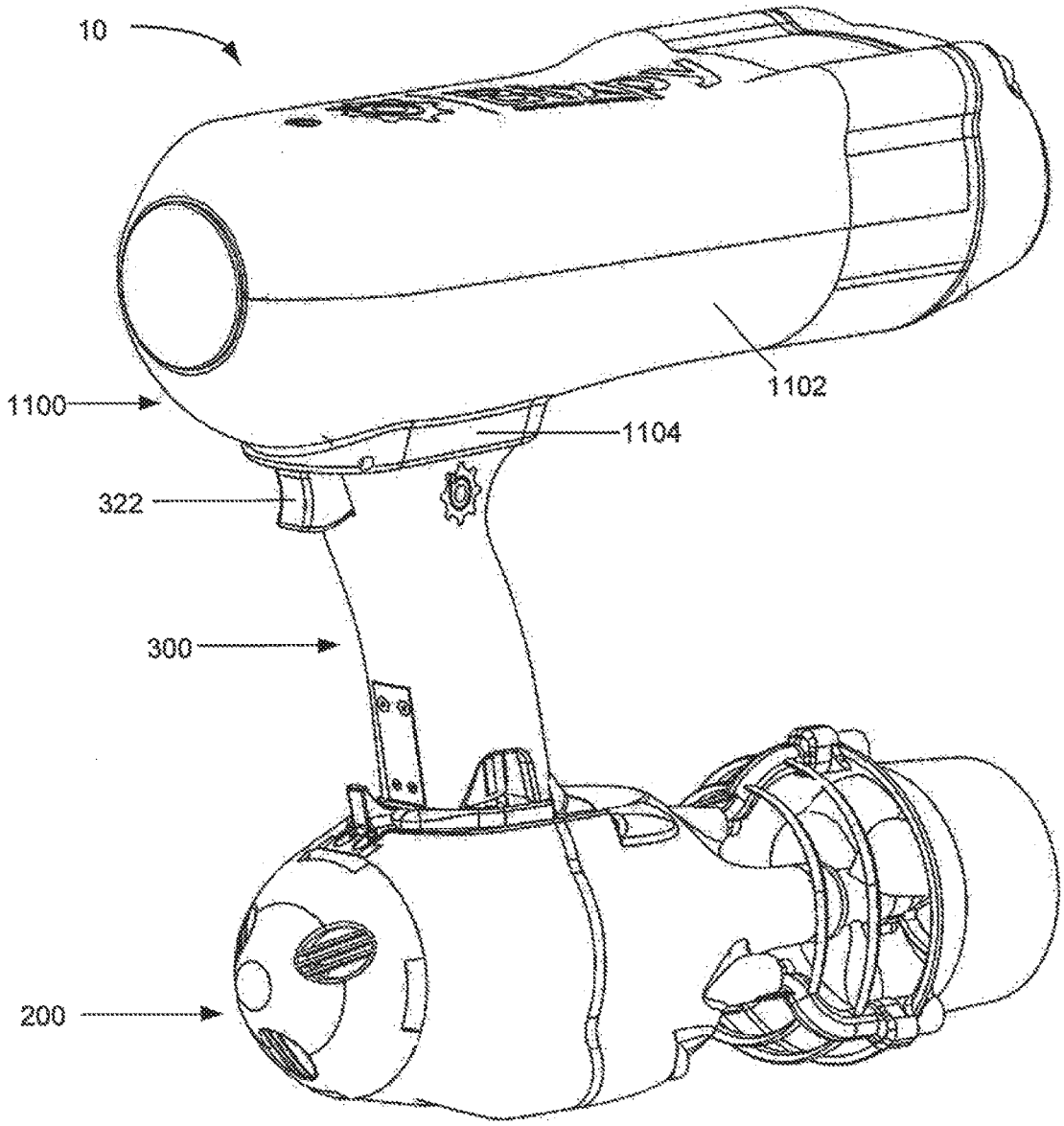
FIG. 10 is a perspective of a propulsion system attached to a power supply unit supporting a power supply to allow for handheld operation of the propulsion system in accordance with another embodiment.

It will be appreciated although controller 400 is shown in FIG. 10 is an independent device, in alternative embodiments, an electronic device, such as a smartphone, may include an application program, which when executed by a processor of the electronic device, wirelessly communicates with the processor of the propulsion device 200 via the processor (not shown) of the power supply pack 100 to control operation of the propulsion device 200. It will be also appreciated that in alternative embodiments, the controller 400 may also include a global positioning system (GPS) device and a display. The controller 400 may be configured to display information, including distance travelled by the propulsion device 200, the current speed of the propulsion device 200, location received from the GPS, and information received from the processor (not shown) of the propulsion device 200 and information received from the processor (not shown) of the power supply pack 100.

FIG. 10 illustrates another embodiment of a propulsion system 10 that is used to propel a person through a body of water. In the embodiment shown in FIG. 10, propulsion system 10 includes a power supply unit 1100 supporting a power supply (not shown), the propulsion device 200, and the adapter 300. The power supply unit 1100 comprises a watertight casing 1102 that houses the power supply (not shown) to inhibit water for entering the power supply unit 1100 when disposed in a body of water. The power supply may be any suitable power supply, such as, for example, a battery (not shown). The power supply unit 1100 also includes an attachment adapter 1104 configured to mechanically attach to the first end 302 of the adapter 300 to form a watertight seal between the power supply unit 1100 and the adapter 300 and a processor (not shown). In the embodiment shown in FIG. 10, the attachment adapter 1104 is integral with the casing 1102 and extends from a bottom surface of the casing 1102.

The attachment adapter 1104 includes an electrical contact (not shown) that electrically connects the power supply unit 1100 to the electrical conduit 306 of the adapter 300 to supply power to the propulsion device 200. The processor (not shown) communicates with the processor (not shown) of the propulsion device 200 via the electrical contact (not shown), the electrical conduit, and the electrical connection 208. The adapter 300 is shaped and dimensioned to be gripped by a hand of a person using the propulsion system 10. The adapter 300 further includes a trigger mechanism 322 that is electrically connected to the processor (not shown) of the power supply pack 100. The processor (not shown) of the power supply unit is configured to detect depression and release of the trigger mechanism 322 and transmit signals to the processor (not shown) of the propulsion device 200 indicating detection of depression or release of the trigger mechanism 322. The processor (not shown) of the propulsion device 200 is configured to throttle the motor 204 when a signal indicating that depression of the trigger mechanism 322 is detected is received from the processor (not shown) of the power supply pack 100. The processor (not shown) of the propulsion device 200 is also configured to turn off the motor 204 when a signal indicating that release of the trigger mechanism 322 is detected is received from the processor (not shown) of the power supply pack 100.

It will be appreciated that although the example embodiments of the propulsion system 10 are used to propel a SUP 15 and a person, other types of watercraft may be propelled through a body of water by the propulsion system 10. For example, in one alternative embodiment, the propulsion system 10 may be utilized to propel a surfboard through a body of water. In this embodiment, the propulsion system 10 is mounted to a fin box formed in a bottom surface of a surfboard using an attachment adapter 30.

Figure 11:
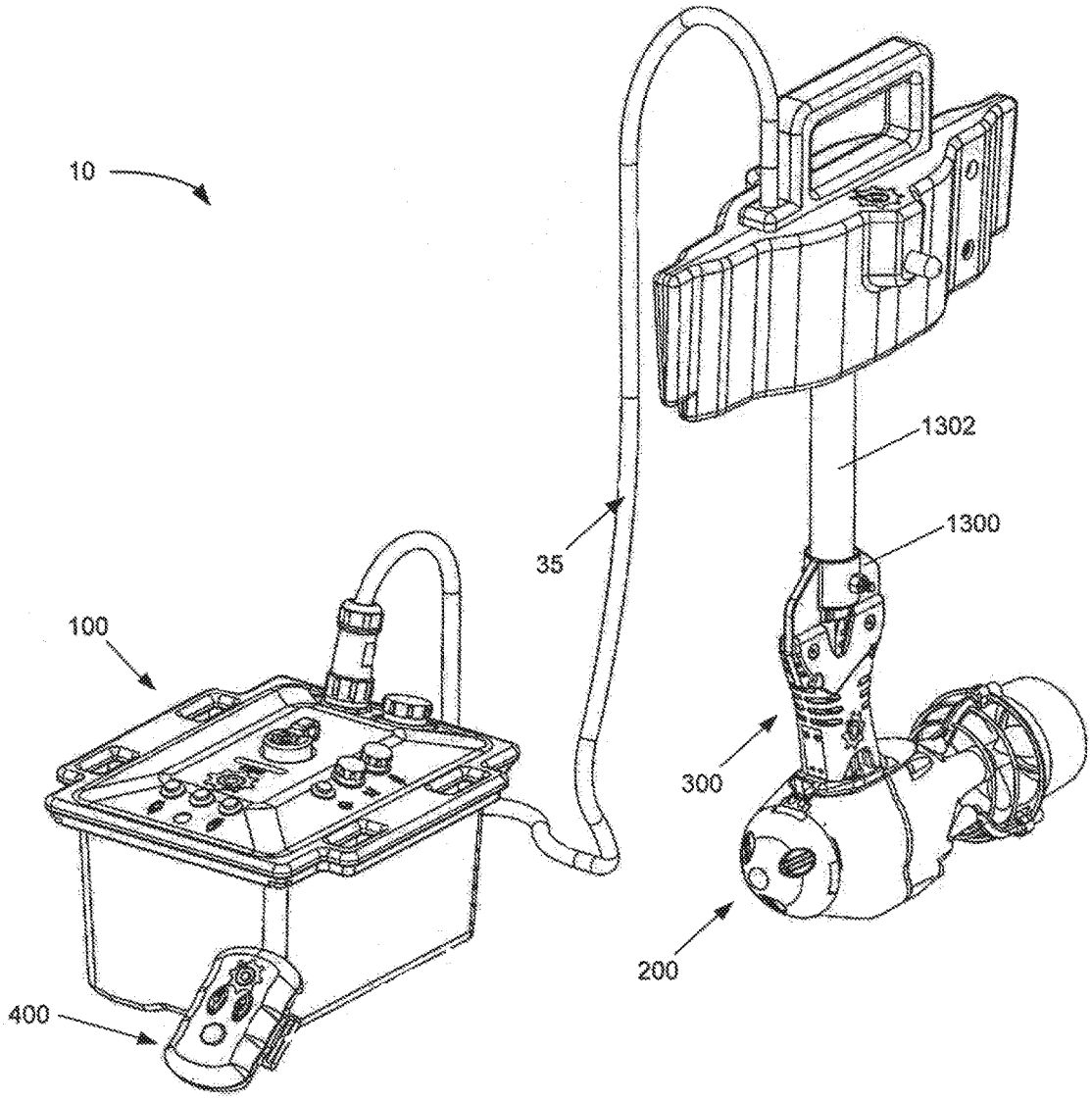
FIG. 11 is a perspective view of a propulsion system attached to a peripheral that is mountable within a belly of a watercraft in accordance with another embodiment.

In another alternative embodiment, the propulsion system 10 may be utilized to propel a watercraft, such as Hobie® kayaks with the MirageDrive® system as illustrated in FIG. 11. In the embodiment shown in FIG. 11, the power supply pack 100 is disposed on and supported by a surface of a watercraft (not shown) and an attachment adapter 1300 is configured for attachment to peripheral 1302 that is mountable within a belly (e.g. an opening in the belly of the watercraft (not shown).

Figure 12:
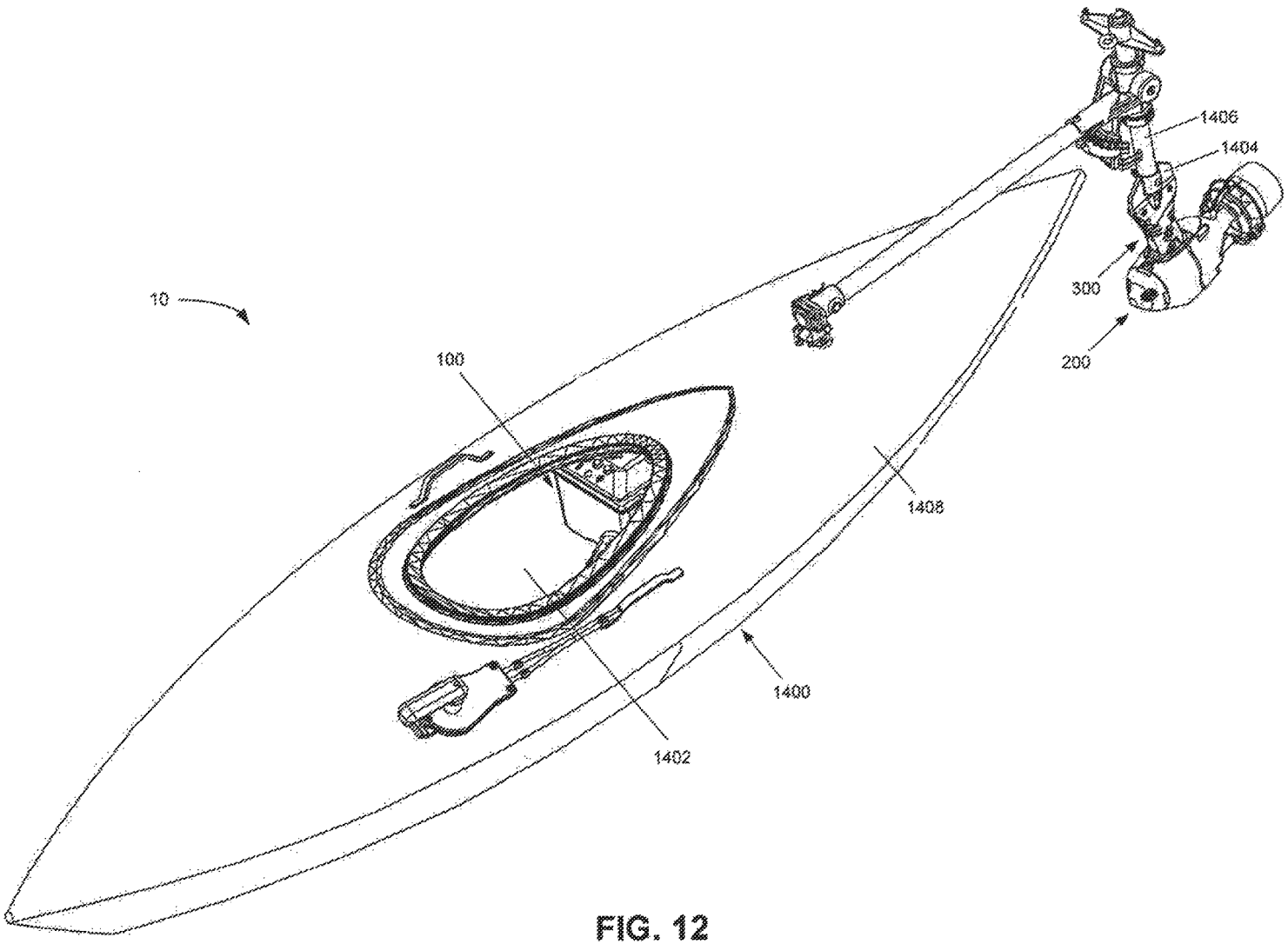
FIG. 12 is a perspective view of a propulsion system attached to a peripheral that is mounted to a surface of a watercraft in accordance with another embodiment.

In still another embodiment, the propulsion system 10 may also be used to propel a kayak 1400 as shown in shown in FIG. 12. In the embodiment shown in FIG. 12, the power supply pack 100 is disposed within a cockpit 1402 of the kayak 1400 such that the power supply pack 100 is supported by a surface of the cockpit 1402. An attachment adapter 1404 is configured for attachment to peripheral 1406 that mounts to a top surface 1408 of the kayak 1400. In the example embodiment shown in FIG. 12, the peripheral 1406 comprises a steering mount configured to steer the kayak 1400 as the propulsion system 10 propels the kayak 1400 through a body of water.

Although the power supply pack 100 is shown in FIG. 12 disposed within the cockpit 1402 of the kayak 1400, it will be appreciated that in alternative embodiments, the power supply pack 100 may be mounted on the top surface 1408 of the kayak 1400.

In another embodiment, the propulsion system 10 may also be used to propel a canoe using the attachment adapter 1404.

In another embodiment of the present invention, the propulsion device 200 may include a hose (not shown) configured for attachment to the propeller guard 232 of the propulsion device 200. When the propulsion system 10 is disposed within a body of water and the input device 402 of the controller is actuated, water ejected by the propeller 206 is directed into the hose and ejected from the hose. In other words, the hose acts as a water pump.

It will also be appreciated that the above description relates to the embodiments by way of example only. Many variations on the disclosure will be obvious to those knowledgeable in the field, and such obvious variations are within the scope of the disclosure as described and claimed, whether or not expressly described. The terms top, bottom, downward, upward, vertical, and horizontal are utilized herein to provide reference to the orientation of the print head assembly in use.

In the preceding description, for purposes of explanation, numerous details are set forth in order to provide a thorough understanding of the embodiments. However, it will be apparent to one skilled in the art that these specific details are not required. The above-described embodiments are intended to be examples only. Alterations, modifications and variations can be effected to the particular embodiments by those of skill in the art without departing from the scope, which is defined solely by the claims appended hereto.

What is claimed is:

1. A propulsion system comprising:

a power supply unit comprising:

a watertight casing housing a power supply;

an attachment adapter integral with the watertight casing and extending from a bottom surface of the watertight casing, the attachment adapter comprising an electrical contact;

a propulsion device comprising:

a housing comprising an outer surface;

a motor disposed within the housing and coupled to a propeller for generating propulsion forces for propelling the propulsion device; and a coupling mechanism on the outer surface of the housing, and an electrical connection disposed within the coupling mechanism and connected to the motor;

an adapter comprising:

a body having an open first end and a second end; and an electrical conduit extending between the first end and the second end of the body; and a complementary coupling mechanism;

the adapter configured to receive a portion of the attachment adapter in the open first end, to couple to the portion of the attachment adapter, and to electrically connect the electrical contact of the attachment adapter to the electrical conduit;

the complementary coupling mechanism configured to releasably attach to coupling mechanism on the outer surface of the housing of the propulsion device to mechanically connect to the coupling mechanism to form a watertight seal between the coupling mechanism and the complementary coupling mechanism, and to electrically connect the electrical conduit to the electrical connection to supply power from the power supply to the motor; and a trigger mechanism coupled to the body at the first end, the trigger mechanism being electrically connected to the motor via the electrical conduit and configured to control operation of the motor.

2. The propulsion system of claim 1, wherein the propulsion device is configured to throttle the motor when depression of the trigger mechanism is detected and to turn off the motor when release of the trigger mechanism is detected.

3. The propulsion system of claim 1, wherein the adapter is shaped to be grasped by a hand of a person for propelling the person.

4. The propulsion system of claim 1, wherein the electrical conduit is an electrical cable coupled to power supply for electrically connecting the power supply to the motor.

5. The propulsion system of claim 1, wherein the housing further comprises a plurality of water inlets configured to intake water and to direct the water towards a heat sink of the propulsion device.

6. The propulsion system of claim 1, wherein the electrical conduit comprises a plug and the electrical connection comprises a socket for receiving the plug when the complementary coupling mechanism is attached to coupling mechanism.

7. A propulsion system, for propelling a watercraft comprising:

a power supply encased in a power supply pack, the power supply pack comprising an electrical contact electrically connected to the power supply;

a peripheral mountable to watercraft;

an attachment adapter for attachment to the peripheral;

a propulsion device comprising:

a housing comprising an outer surface;

a motor disposed within the housing and coupled to a propeller for generating propulsion forces for propelling the propulsion device;

a coupling mechanism on the outer surface of the housing; and an electrical connection disposed within the coupling mechanism and connected to the motor;

an adapter comprising:

a body having an open first end and a second end;

an electrical conduit extending between the first end and the second end of the body; and, a complementary coupling mechanism;

the adapter configured to receive a portion of the attachment adapter in the open first end and couple to the portion of the attachment adapter, and to electrically connect the electrical contact of the attachment adapter to the electrical conduit;

the complementary coupling mechanism configured to releasably attach to coupling mechanism on the outer surface of the housing of the propulsion device to mechanically connect to the coupling mechanism to form a watertight seal between the coupling mechanism and the complementary coupling mechanism, and to electrically connect the electrical conduit to the electrical connection; and an electric cable coupled to the electrical contact on the power supply pack and the electrical conduit of the adapter to supply power from the power supply to the motor.

8. The propulsion system of claim 7, wherein the peripheral is mountable within a belly the watercraft.

9. The propulsion system of claim 7, wherein the electrical conduit of the adapter comprises a plug and the electrical connection comprises a socket for receiving the plug when the complementary coupling mechanism is attached to coupling mechanism.

10. The propulsion system of claim 7, wherein the electrical conduit of the adapter is an electrical cable coupled to electrical cable for electrically connecting the power supply to the motor.

11. The propulsion system of claim 7, further comprising a controller configured to communicate with the propulsion device for controlling the propulsion device and for receiving information related to the operation of the propulsion device.

12. The propulsion system of claim 11, wherein the controller communicates wirelessly with the power supply.

13. The propulsion system of claim 7, wherein the peripheral is mountable to top surface of the watercraft.

14. The propulsion system of claim 7, wherein the watercraft is a kayak or a canoe.

15. A propulsion system for propelling a stand-up paddleboard comprising:

a power supply encased in a power supply pack, the power supply pack comprising an electrical contact electrically connected to the power supply;

an attachment adapter for mounting within a fin box formed in a bottom surface of the stand-up paddleboard;

a propulsion device comprising:

a housing comprising an outer surface;

a motor disposed within the housing and coupled to a propeller for generating propulsion forces for propelling the propulsion device;

a coupling mechanism on the outer surface of the housing; and an electrical connection disposed within the complementary coupling mechanism and connected to the motor;

an adapter comprising:

a body having an open first end and a second end;

an electrical conduit extending between the first end and the second end of the body; and, a complementary coupling mechanism;

the adapter configured to receive a portion of the attachment adapter in the open first end and couple to the portion of the attachment adapter, and to electrically connect the electrical contact of the attachment adapter to the electrical conduit;

the complementary coupling mechanism configured to releasably attach to coupling mechanism on the outer surface of the housing of the propulsion device to mechanically connect to the coupling mechanism to form a watertight seal between the coupling mechanism and the complementary coupling mechanism, and to electrically connect the electrical conduit to the electrical connection; and an electric cable coupled to the electrical contact on the power supply pack and the electrical conduit of the adapter to supply power from the power supply to the motor.

16. The propulsion system of claim 15, wherein the electrical conduit comprises a plug and the electrical connection comprises a socket for receiving the plug when the complementary coupling mechanism is attached to coupling mechanism.

17. The propulsion system of claim 15, wherein the electrical conduit of the adapter is an electrical cable coupled to electrical cable for electrically connecting the power supply to the motor.

18. The propulsion system of claim 15, further comprising a controller configured to communicate with the propulsion device for controlling the propulsion device and for receiving information related to the operation of the propulsion device.

19. The propulsion system of claim 18, wherein the controller communicates wirelessly with the power supply.

* * * * *